US009560888B2

(12) United States Patent
Kiraly

(10) Patent No.: US 9,560,888 B2
(45) Date of Patent: Feb. 7, 2017

(54) INFANT GLOVE HAVING A REVERSIBLE POCKET

(71) Applicant: Jennifer Kiraly, Fountain Hills, AZ (US)

(72) Inventor: Jennifer Kiraly, Fountain Hills, AZ (US)

( * ) Notice: Subject to any disclaimer, the term of this patent is extended or adjusted under 35 U.S.C. 154(b) by 409 days.

(21) Appl. No.: 14/161,419

(22) Filed: Jan. 22, 2014

(65) Prior Publication Data

US 2014/0207187 A1 Jul. 24, 2014

Related U.S. Application Data

(60) Provisional application No. 61/755,087, filed on Jan. 22, 2013.

(51) Int. Cl.

| | |
|---|---|
| ***A41D 19/00*** | (2006.01) |
| ***A61J 17/00*** | (2006.01) |
| *A41D 19/01* | (2006.01) |

(52) U.S. Cl.

CPC ..... *A41D 19/0037* (2013.01); *A61J 17/00* (2013.01); *A41D 19/01* (2013.01); *A61J 17/001* (2015.05); *A61J 17/008* (2015.05)

(58) Field of Classification Search

CPC ..... A41D 19/0037; A41D 19/01; A61J 17/00; A61J 17/001

See application file for complete search history.

(56) References Cited

U.S. PATENT DOCUMENTS

| | | | | |
|---|---|---|---|---|
| 2,902,693 | A * | 9/1959 | Wells, Jr. | A41D 19/01 2/158 |
| 6,233,742 | B1 | 5/2001 | Yungkurth | |
| 6,769,139 | B1 | 8/2004 | Goldkind | |
| 8,458,814 | B1 * | 6/2013 | Voto | A41D 19/01 2/160 |
| 2007/0288056 | A1 | 12/2007 | Goldwire | |
| 2009/0163952 | A1 | 6/2009 | Kash | |
| 2014/0207187 | A1 * | 7/2014 | Kiraly | A61J 17/00 606/223 |

OTHER PUBLICATIONS

PCT/US14/12587 International Search Report and Written Opinion. Date of Mailing: Apr. 28, 2014. 19 pp.

* cited by examiner

*Primary Examiner* — Shaun R Hurley
*Assistant Examiner* — Andrew W Sutton
(74) *Attorney, Agent, or Firm* — Schmeiser, Olsen & Watts LLP

(57) ABSTRACT

A pacifier glove is provided. The pacifier glove includes a mitten body having opposing sides and having a closed end and an open end, the opposing sides of the mitten body defining an opening there between, the opening being accessible via the open end. An elastic member is configured on the mitten body and proximate the open end, and a strap member is configured on an opposing side of the mitten body and proximate the open end, the strap member opposing the elastic member. A pocket is configured on an exterior surface of the mitten body, the pocket having exterior and interior surfaces. A pacifier is coupled to the exterior surface of the pocket, and the pocket is configured to be turned inside-out on the mitten body to create an inside-out pocket. Under the condition that the pocket is turned inside-out, the pacifier is repositioned within the inside-out pocket.

17 Claims, 6 Drawing Sheets

INFANT GLOVE HAVING A REVERSIBLE POCKET

CROSS REFERENCE TO RELATED APPLICATION[S]

This application claims priority to U.S. Provisional Patent Application to Kiraly entitled "INFANT MITTEN HAVING A REVERSIBLE POCKET," Ser. No. 61/755,087, filed Jan. 22, 2013, the disclosure of which is hereby incorporated entirely herein by reference.

BACKGROUND

Technical Field

The following relates generally to the field of infant gloves and in particular to a glove, including, for example, a mitten, that may be worn by an infant or toddler and may be configured with a pacifier thereon.

State of the Art

Pacifiers can be an infant caregiver's dream. Pacifiers are often utilized by parents, or caregivers, to calm, or otherwise soothe, an agitated baby. Infants, and all mammals for that matter, are born with a rooting and sucking reflex. These reflexes complement one another to cause the infant to instinctively suck anything that touches the roof of its mouth, and simulates the way an infant naturally eats. It follows that a pacifier placed in an infant's mouth triggers this reflex. In addition, it is widely believed that the act of sucking triggers a calming reflex in the infant, thus helping to calm and soothe an otherwise agitated infant.

Pacifiers are known in the art. Because of their same general purpose, different brands of pacifiers often have a similar common design. Pacifiers are generally comprised of a mouth shield, which is often comprised of rigid plastic, with a resilient teat, often comprised of rubber, plastic, or silicone, centrally located on one side of the mouth shield and protruding therefrom, and a handle on the opposing side of the mouth shield, opposite the teat.

The mouth shield is usually designed to be large enough to abut the infant's mouth without the infant being able to place the entire mouth shield within the infant's mouth, for safety. The attached teat is configured to enter the infant's mouth and cause the infant to begin sucking, via reflex. The handle permits the caregiver to pull on the handle to dislodge the pacifier from the infant's mouth, as needed.

In some cases, an infant will disengage the pacifier in its own mouth by ceasing to perform the sucking reflex, thus causing the pacifier to fall out of the infant's mouth. In other cases, the infant will grip and pull on the handle and unwittingly dislodge the pacifier from its mouth. Under such circumstances, if the caregiver wishes for the infant to continue to use the pacifier, the caregiver must find the pacifier and physically place the pacifier back into the infant's mouth until the infant reengages the pacifier via the sucking reflex. This process may need to be repeated and maintained until the infant is either asleep or soothed without the need of the pacifier. This can be particularly burdensome at night.

Thus, there is a need in the art for an apparatus and/or system that incorporates an infant pacifier that addresses the concerns described above.

SUMMARY

The following relates generally to the field of infant gloves and in particular to a glove, including, for example, a mitten, that may be worn by an infant or toddler and may be configured with a pacifier thereon.

A first general aspect relates to an infant glove comprising a body having a first side and a second side and an open end, the first and second sides of the body defining an opening there between, the opening being accessible via the open end, the opening being configured to receive an infant's hand, a pocket configured on the first side of the body, the pocket being configured to be turned inside-out, and a pacifier coupled to the infant glove, wherein the pocket being turned inside-out repositions the pocket on the second side of the body with the pacifier retained within the inside-out pocket.

Another general aspect relates to wherein the body is a mitten.

Another general aspect relates to wherein the pacifier is releasably coupled to the pocket and turning the pocket inside-out results in an inside-out pocket on the second side of the body with the pacifier retained between the inside-out pocket and the body.

Another general aspect relates to wherein the pacifier is fixedly coupled to the pocket and turning the pocket inside-out results in an inside-out pocket on the second side of the body with the pacifier retained between the inside-out pocket and the body.

Another general aspect relates to first and second coupling straps, the first coupling strap being configured on an edge of the pocket and the second coupling strap being configured on an opposing edge of the pocket, the first and second coupling straps being configured to communicate with one another to releasably secure the pacifier to the pocket.

Another general aspect relates to wherein the first coupling strap is configured to secure a portion of the pacifier between the pocket and the first coupling strap, and wherein the second coupling strap is configured to secure another portion of the pacifier between the first coupling strap and the second coupling strap.

Another general aspect relates to wherein the inside-out pocket conceals the first and second coupling straps therein.

Another general aspect relates to an elastic member configured on the first side of the body and proximate the open end.

Another general aspect relates to a strap member configured on the second side of the body and proximate the open end.

Another general aspect relates to wherein the pocket further comprises a slanted opening that partially conceals the pacifier within the inside-out pocket.

Another general aspect relates to a pacifier holder comprising a mitten body having a first side and a second side and an open end, the first and second sides of the mitten body defining an opening there between, the opening being accessible via the open end, a pocket configured on the first side of the mitten body, the pocket being configured to be turned inside-out, and coupling means for coupling a pacifier to the pocket, wherein the pocket being turned inside-out repositions the pocket on the second side of the mitten with the pacifier and the coupling means within the inside-out pocket.

Another general aspect relates to wherein the coupling means releasably couples the pacifier to the pocket and turning the pocket inside-out results in an inside out pocket on the second side of the body with the pacifier retained between the inside-out pocket and the body.

Another general aspect relates to wherein the coupling means fixedly couples the pacifier to the pocket and turning the pocket inside-out results in an inside out pocket on the second side of the body with the pacifier retained between the inside-out pocket and the body.

Another general aspect relates to wherein the coupling means comprises first and second coupling straps, the first coupling strap being configured on an edge of the pocket and the second coupling strap being configured on an opposing edge of the pocket, the first and second coupling straps being configured to communicate with one another to releasably secure the pacifier to the pocket.

Another general aspect relates to wherein the first coupling strap is configured to secure a portion of the pacifier between the pocket and the first coupling strap, and wherein the second coupling strap is configured to secure another portion of the pacifier between the first coupling strap and the second coupling strap.

Another general aspect relates to a method of using a pacifier, the method comprising providing an infant glove having first and second sides and a pocket on the first side securing a pacifier to the pocket, and turning the pocket inside-out to reposition the pocket as an inside-out pocket on the second side of the infant glove with the pacifier within the inside-out pocket.

Another general aspect relates to wherein securing the pacifier to the pocket further comprises securing a portion of the pacifier between the pocket and a first coupling strap, and securing another portion of the pacifier between the first coupling strap and a second coupling strap.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

Figure 1:
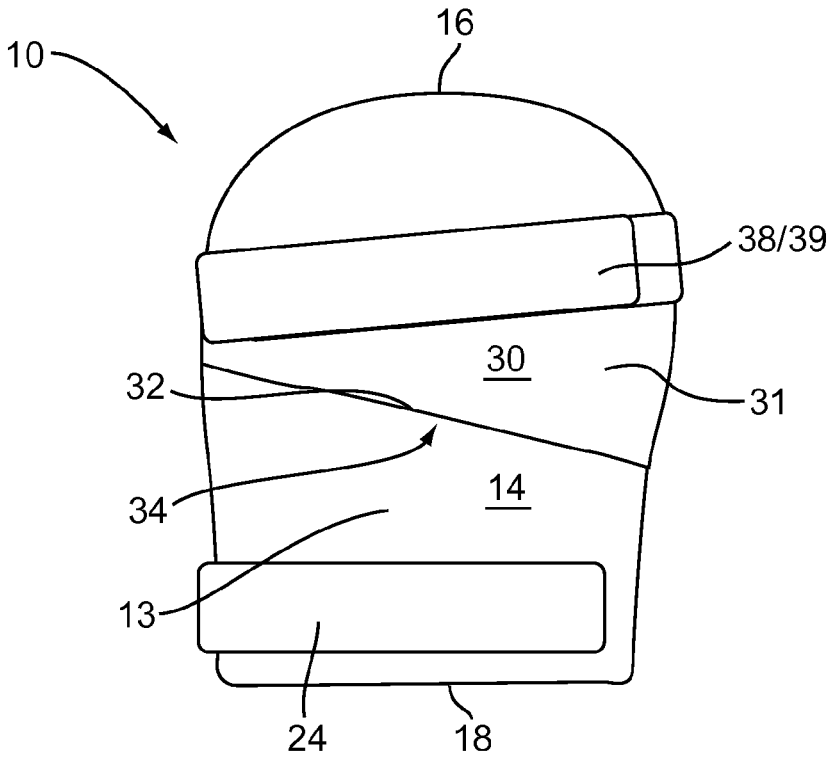
FIG. 1 is a rear view of an embodiment of a glove/mitten in accordance with the present disclosure.
Figure 2:
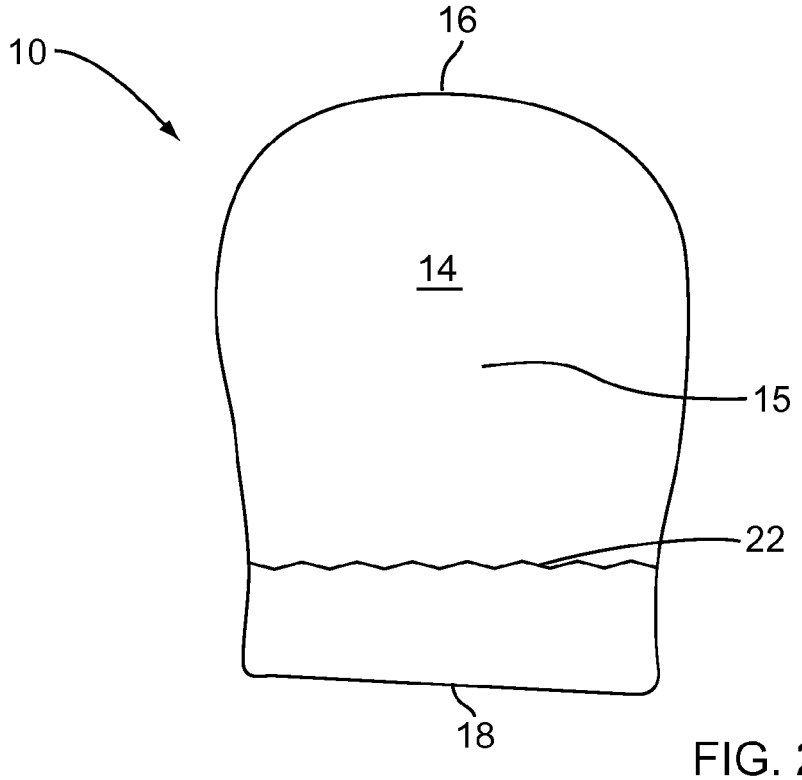
FIG. 2 is a front view of an embodiment of a glove/mitten in accordance with the present disclosure.

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Referring to the drawings, FIGS. 1-5 depict an embodiment of an infant glove. Embodiments of the glove may include the glove being formed as a normal infant glove with finger placements for each of the five fingers of an infant's hand. Embodiments of the glove may include the glove being formed as a mitten 10. Embodiments of the mitten 10 may comprise various structural and functional components that complement one another to provide the unique functionality and performance of the mitten 10, the structure and function of which will be described in greater detail herein. Embodiments of the mitten 10 may comprise a mitten body 14, a pocket 30, and coupling means 38 for coupling a pacifier 40 to the mitten 10.

Embodiments of the infant mitten 10 may comprise a mitten body 14 having a first side 13 and a second side 15 on opposite sides of the mitten 10 to one another. Embodiments of the infant mitten 10 may further comprise a mitten body 14 having a closed end 16 and an open end 18 that oppose one another. Embodiments of the infant mitten 10 may further comprise the mitten body 14 having an elastic member 22 on one or each of the first or second sides 13 or 15 and a strap member 24 on the opposing first or second sides 13 or 15. Embodiments of the infant mitten 10 may further comprise a mitten body 14 having a pocket 30 configured on an exterior surface of the mitten body 14. Embodiments of the infant mitten 10 may further comprise a mitten body 14 having an infant pacifier 40 coupled to the pocket 30 at one or more locations on the pocket 30. Embodiments of the infant glove may further comprise the mitten body 14 including finger placements for each of the five fingers of an infant's hand. The pocket 30 may be functionally coupled to the back side of one or more of the finger placements and the pacifier 40 may be coupled to the pocket 30.

Embodiments of the infant mitten 10 may comprise the mitten body 14. The mitten body 14 may be comprised of soft washable fabrics that stretch and are washable cotton or plush velour materials. Embodiments of the mitten 10 may further comprise the mitten body 14 being comprised of 85% solid cotton jersey fabric and 15% viscose, such that the mitten 10 may slightly stretch. The mitten body 14 may be configured to extend down the infant's wrist. The mitten body 14 may be configured to extend down the infant's wrist about two inches. In other words, the mitten body 14 may utilize more fabric to extend the mitten body 14 down below the strap member 24 to allow the mitten body 14 to engage the infant's wrist more fully and to allow the strap member 24 to engage the infant's wrist without also contacting the infant's palm.

Embodiments of the infant mitten 10 may comprise the mitten body 14 having first and second sides 13 and 15, mentioned above. The first and second sides 13 and 15 may oppose one another. The first and second sides 13 and 15 may be configured to define therebetween an opening 12, the opening 12 being configured to receive an infant's hand. In other words, the opening 12 may be configured to receive the infant's hand. The opening 12 may be of a size and shape to retain the infant's hand with the hand in the open position (i.e., open palm) or in the closed position (i.e., a fist). The first and second sides 13 and 15 may be configured in any size and shape that is convenient and conducive to the mitten 10 being placed over and remain on an infant's hand. Embodiments of the mitten 10 may include the mitten 10 being configured to be worn on either hand of the infant and in either direction, with the first or second sides 13 or 15 facing the palm of the infant's hand. Embodiments of the mitten 10 may include the mitten 10 being configured to be worn on either hand of the infant, with the first or second sides 13 or 15 having the pocket 30 thereon corresponding to the back of the infant's hand (not the palm side). Alternatively, embodiments of the mitten 10 may include the mitten 10 being configured to be worn on either hand of the infant, with the first or second sides 13 or 15 having the pocket 30 thereon corresponding to the palm of the infant's hand.

Figure 8:
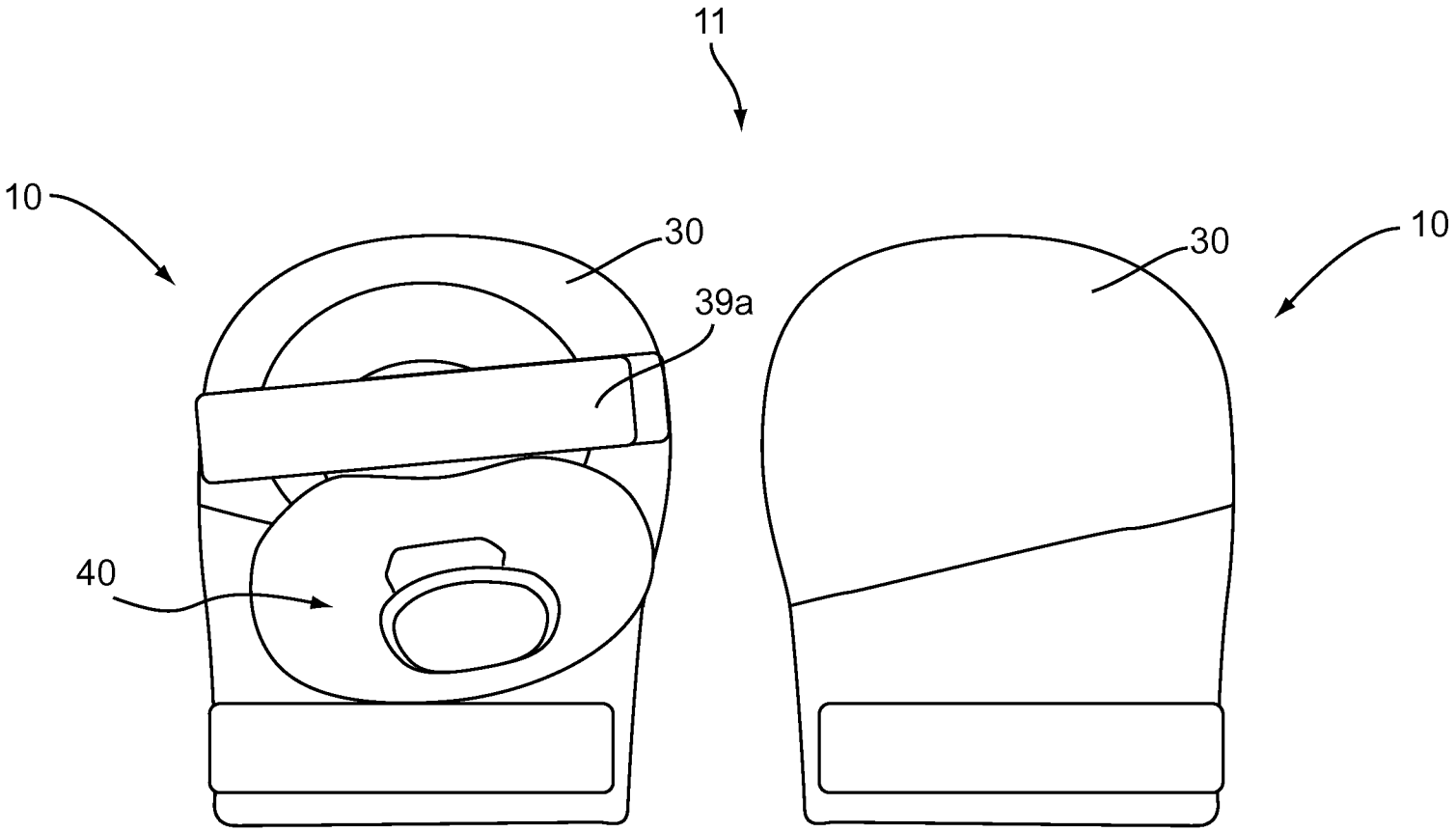
FIG. 8 is a back view of an embodiment of a pair of gloves/mittens in accordance with the present disclosure.

Embodiments of the mitten 10 may include the mitten 10 being configured in a pair 11, such that one mitten 10 of the pair 11 of mittens 10 may be worn on each hand of the infant and in either direction, with either the first side 13 or second side 13 facing the palm of the infant's hand. Embodiments of the pair 11 of mittens 10 may include one mitten 10 of the pair 11 of mittens 10 being configured to be worn on one hand of the infant with the other mitten 10 on the other hand. One mitten 10 may have the pocket 30 the side 13 or 15 and may be oriented on the infant's hand such that the side 13 or 15 of the mitten 10 with the pocket 30 corresponds to the infant's palm, whereas the other mitten 10 may have the pocket 30 the side 13 or 15 and is oriented on the infant's hand such that the side 13 or 15 of the mitten 10 with the pocket 30 corresponds to the infant's back of the hand (opposite the palm). Alternatively, one mitten 10 of the pair 11 of mittens 10 may have the pocket 30 on the side 13, whereas the other mitten 10 of the pair 11 of mittens 10 may not have a pocket 30 thereon at all, as depicted in FIG. 8.

Embodiments of the infant mitten 10 may further comprise the mitten body 14 having a closed end 16 and an open end 18. The closed end 16 may define the terminal end of the opening 12. In embodiments where the infant glove is a glove having five finger placements, the closed end 16 may comprise the end of the finger placements. The open end 18 may define the initial accessible end of the opening 12. In other words, the infant's hand may access the opening 12 via the open end 18 and may enter into the opening 12 until the infant's hand abuts the closed end 16 or until the mitten 10 covers a desirable portion of the infant's hand.

Embodiments of the infant mitten 10 may further comprise the mitten body 14 having an elastic member 22 configured on the mitten body 14 at a position proximate the open end 18. The elastic member 22 may be configured to stretch, expand, or otherwise give, as an infant's hand is placed within the opening 12. Once the infant's hand has passed under the expanded elastic member 22, the elastic member 22 may relax and return to its normal length, thus securing the mitten 10 around the infant's lower hand under the thumb or around the infant's wrist. The elastic member 22 may be configured as an elastic band, or other stretchy material, that is stitched into the mitten body 14.

Embodiments of the infant mitten 10 may further comprise the mitten body 14 having a strap member 24 configured on the mitten body 14 at a position proximate the open end 18. The strap member 24 may be configured on an opposing side of the mitten body 14 from the elastic member 22. Alternatively, the strap member 24 may be configured on the same side of the mitten body 14 as the elastic member 22. The strap member 24 may comprise a first end 26 that is coupled to the mitten body 14. The strap member 24 may be configured to couple to an attachment member 28 positioned on the mitten body 14. The strap member 24 and the attachment member 28 may be configured to cooperate with one another, such that the strap member 24 may be adjusted for length on the attachment member 28. In this way, the strap member 24 may be adjusted with respect to the attachment member 28 to further secure the mitten body 14 around the infant's lower hand under the thumb or around the infants' wrist. The strap member 24 and the attachment member 28 may be configured as a hook and loop fastener system, such as Velcro®. The strap member 24 and the attachment member 28 may alternatively be configured with corresponding buttons, snaps, buckles, or other known fastening means. The strap member 24 may cooperate with the elastic member 22, such that as the strap member 24 is tightened on the attachment member 28, the elastic member 22 is stretched, expanded, or otherwise pulled taught, to secure to the infant's hand or wrist.

Embodiments of the infant mitten 10 may further comprise a pocket 30 configured on an exterior surface of the mitten body 14. The pocket 30 may be coupled, adhered, or stitched on the first or second side 13 or 15 of the mitten body 14. Embodiments of the mitten 10 may further comprise the pocket 30 being coupled to the first or second side 13 or 15 of the mitten body 14, such that the edges of the pocket 30 correspond to the edges of the first or second side 13 or 15 upon which the pocket 30 is positioned. The pocket 30 may have a pocket lip 32 that defines the open end of the pocket 30, the pocket lip 32 not being coupled to the mitten body 14. With reference to the overall orientation of the mitten 10, the pocket 30 may appear to be upside down. Moreover, embodiments of mitten 10 may further comprise the pocket 30 being configured to cover a substantial portion of the side of the first or second side 13 or 15 of the mitten body 14, such that the pocket lip 32 extends down to at least the elastic member 22. Embodiments of mitten 10 may further comprise the pocket 30 being configured to cover the entire side of the first or second side 13 or 15 of the mitten body 14, such that the pocket lip 32 extends down to the open end 18 of the mitten body 14. The pocket 30 may have an exterior surface 31 and an interior surface 33. Each of the interior surface 33 and the exterior surface 31 may be comprised of differing materials, differing patterns and prints, and different textures. This differing fabric pattern, print and color provides more visual stimulation for a baby. The pocket 30 may define a pocket space 34 between the interior surface 33 of the pocket 30 and the mitten body 14. Embodiments of the mitten 10 may further comprise one or more pockets 30 being positioned on the mitten body 14. Embodiments of the mitten 10 may comprise two opposing pockets 30 being positioned on the mitten body 14, one pocket 30 on the first side 13 and another pocket 30 on the second side 15.

With reference to FIGS. 4-7, embodiments of the infant mitten 10 may further comprise a pacifier 40 being configured on the pocket 30. Embodiments of the infant mitten 10 may include the pacifier 40 being configured on the top portion of the pocket 30 to be nearer to the closed end 16 of the mitten body 14. Such positioning may be advantageous to the use by certain infants, as determined by a caregiver and as determined by the capabilities of the infant. Embodiments of the infant mitten 10 may include the pacifier 40 being configured in the middle of the pocket 30 to be positioned near the center of the mitten body 14. Such positioning may be advantageous to the use of the mitten 10 by certain infants, as determined by a caregiver and as determined by the capabilities of the infant.

The pacifier 40 may have a base plate 42 and a nipple portion 44. The pacifier 40 may further comprise a handle 46. The pacifier 40 may be coupled to the pocket 30 at the base plate 42. The pacifier 40 may be stitched to the pocket 30. The stitching 41 may be heavy grade stitching, such that the infant cannot dislodge the pacifier 40 from the mitten 10. Embodiments of the mitten 10 may further comprise the pacifier 40 being coupled to the pocket 30, such that the base plate 42 is concealed within the layers of the pocket 30 to be hidden from view and the nipple 44 protrudes through the pocket 30 to be utilized by the infant.

Figure 3:
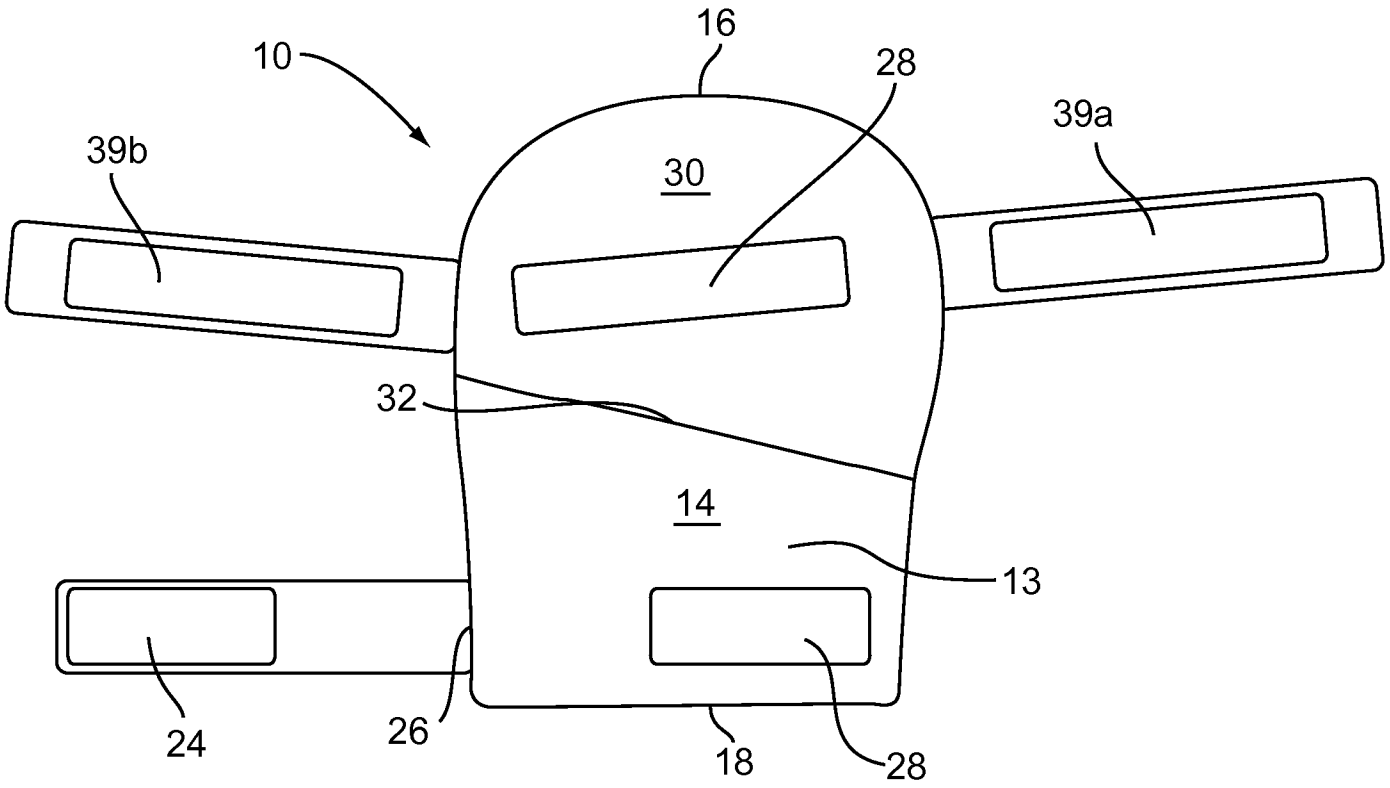
FIG. 3 is a back view of an embodiment of a glove/mitten in accordance with the present disclosure.
Figure 4:
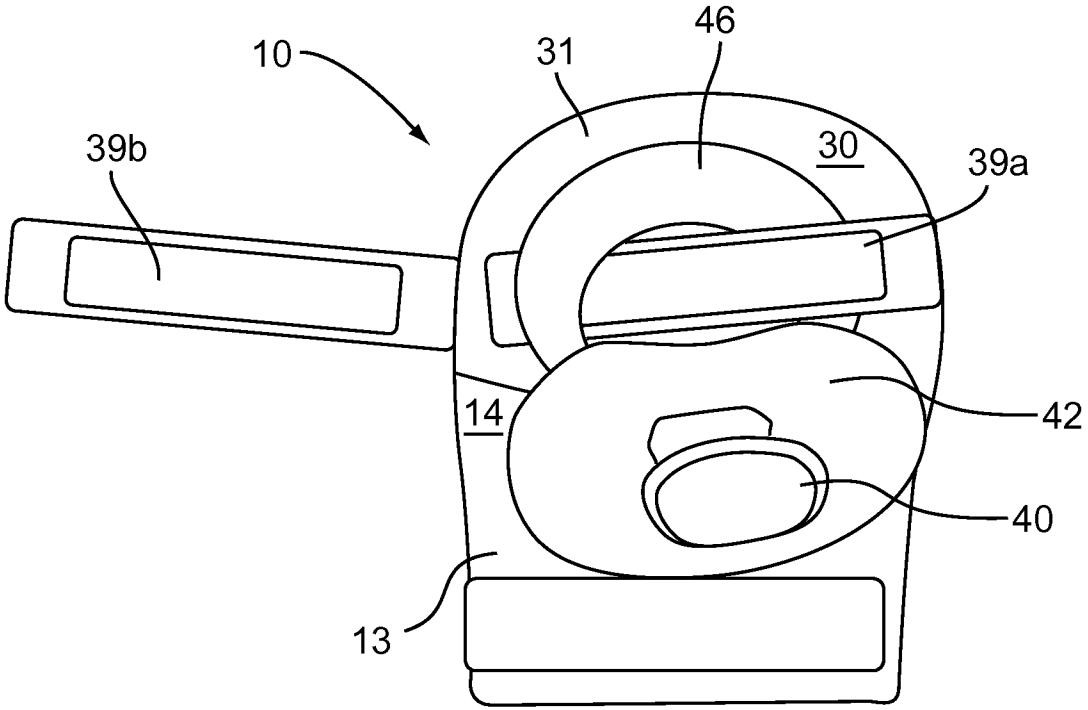
FIG. 4 is a back view of an embodiment of a glove/mitten in accordance with the present disclosure.
Figure 5:
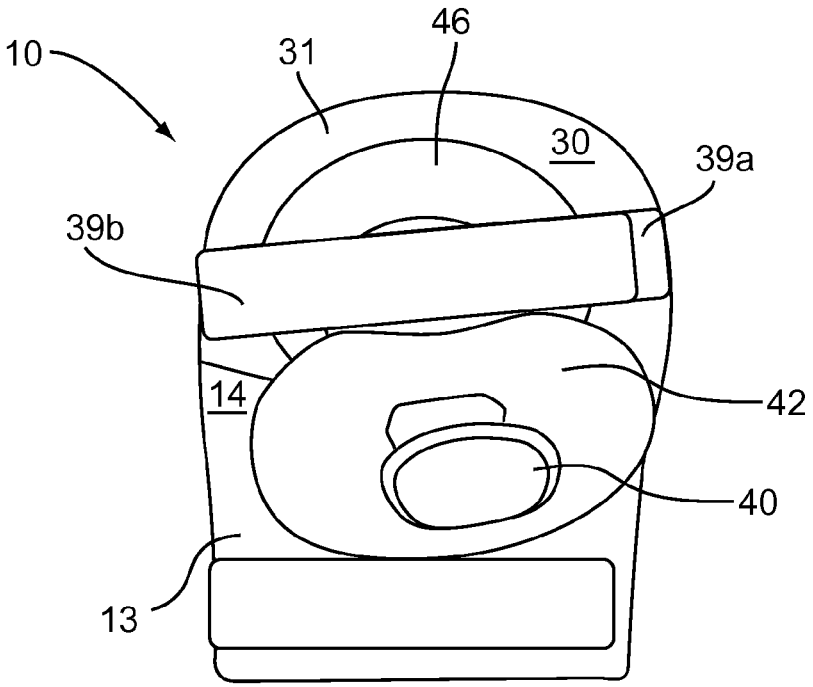
FIG. 5 is a back view of an embodiment of a glove/mitten in accordance with the present disclosure.
Figure 7:
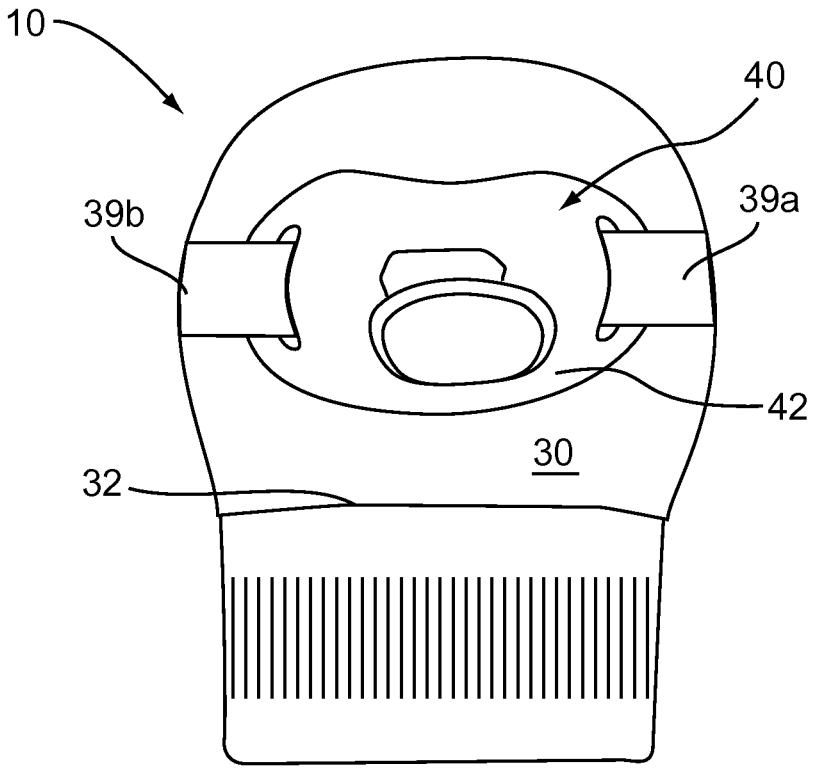
FIG. 7 is a back view of an embodiment of a glove/mitten in accordance with the present disclosure.

With reference to FIGS. 3-5 and 7, embodiments of the infant mitten 10 may further comprise a coupling means 38 for attaching a pacifier 40 to the pocket 30. The coupling means 38 may comprise coupling straps 39 that are configured on the mitten 10 and may be utilized to couple the pacifier 40, either at the handle 46, as shown in FIGS. 3-5, or at the base plate 42, as shown in FIG. 7, to the mitten 10, such that the pacifier 40 may be releasably and repeatedly coupled to the mitten 10 or the pocket 30. The straps 39 may be configured with corresponding buttons, snaps, buckles, hook and loop fasteners, or other known fastening means that are capable of securing the straps 39 to one another or capable of securing the straps 39 around parts of the pacifier 40 and back upon themselves to secure the pacifier 40 to the pocket 30. In this way, any pacifier 40 preferred by the infant and chosen by the parent or caregiver may be releasably coupled to the pocket 30 and thereafter used by the infant. Moreover, in this way, the pacifier 40 may be removed from the mitten 10 or attached to the mitten 10, as needed by the parent or caregiver. The coupling means 38 may be configured such that the infant cannot accidentally undue the coupling means 38, or coupling straps 39, to unintentionally release the pacifier 40 from the mitten 10.

Embodiments of the mitten 10 may include the coupling means 38 being configured on the pocket 30 such that the coupling means 38 is coupled to the pocket 30 at an upper region of the pocket 30 near the top side 16 of the mitten 10. In this way, the pacifier 40 may also be coupled at an upper region of the mitten 10 by the coupling means 38, such as the coupling straps 39. Embodiments of the mitten 10 may include the coupling means 38 being coupled to the pocket 30 proximate the top side 16 of the mitten 10. Embodiments of the mitten 10 may include the coupling means 38 being coupled, or otherwise positioned, relative to the pocket 30 above the midpoint of the pocket 30, the midpoint being defined on the pocket 30 between the top side 16 and the pocket lip 32. In this way, the pacifier 40 may be coupled to the mitten 10 by the coupling means 38, such as the coupling straps 39, above the midpoint of the pocket 30 to advantageously position the pacifier 40 on the mitten 10 to provide more room within the mitten 10 for the infant's hands and to ensure that under the condition the pocket 30 is reversed inside out to create the inside-out pocket 30*a* the pacifier 40 is tucked away inside, retained, sealed, concealed, held, engaged, covered, hidden, or otherwise protected within the inside-out pocket 30*a*. In other words, the further up on the pocket 30 the pacifier 40 is coupled, the deeper within the inside-out pocket the pacifier 40 will be retained. Embodiments of the mitten 10 may include the coupling means 38 being oriented in parallel with respect to the pocket lip 32 to allow the pacifier 40 to be more fully enclosed by the inside-out pocket 30*a* under the condition the pocket 30 is turned inside-out. Embodiments of the mitten 10 may include the coupling means 38 being oriented in an oblique manner with respect to the pocket lip 32 to allow the pacifier 40 to be less enclosed by the inside-out pocket 30*a* under the condition the pocket 30 is turned inside-out.

Figure 6:
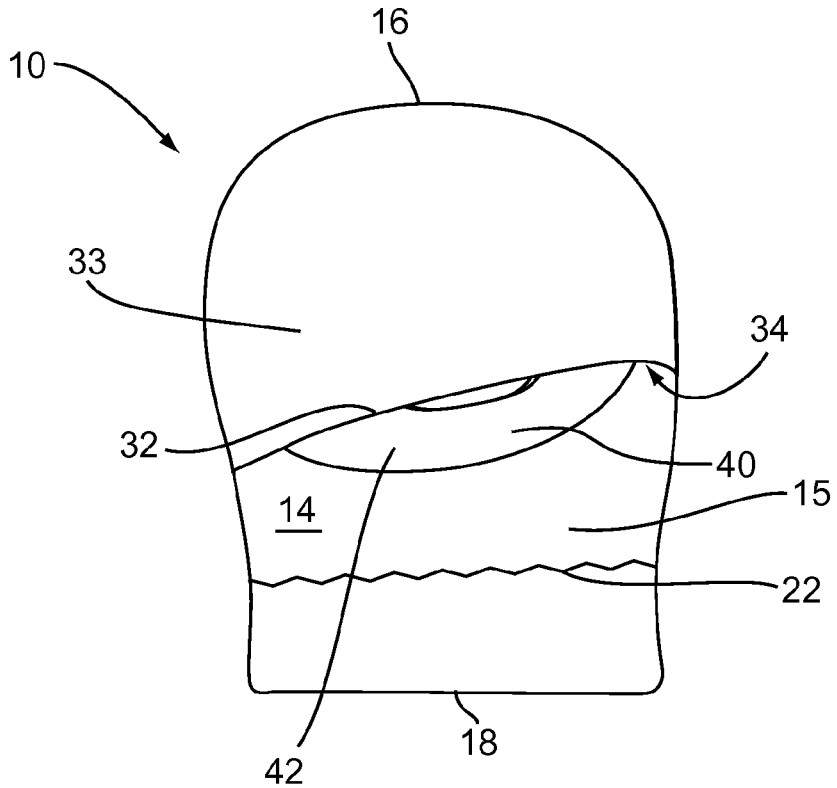
FIG. 6 is a front view of an embodiment of a glove/mitten in accordance with the present disclosure.

With reference to FIGS. 5 and 6, embodiments of the infant mitten 10 may further comprise one or more of the pockets 30 being configured to be a flip-over pocket or a reversible pocket. In other words, the pocket 30 may be configured to be turned inside-out, such that when the pocket 30 is turned inside-out the interior surface 33 of the pocket 30 is newly positioned as the exterior of an inside-out pocket 30*a* and the exterior surface 31 of the pocket 30 is newly positioned as the interior of the inside-out pocket 30*a*. In greater detail, with the exterior surface 31 of the pocket 30 exposed, the pocket lip 32 may be configured to be pulled up over the closed end 16 of the mitten body 14. By so doing, the pocket 30 flips over the top of the mitten 10, is turned inside-out to create an inside-out pocket 30*a* such that the exterior surface 31 and the interior surface 33 of the pocket 30 switch positions, and the pocket 30 repositioned as an inside-out pocket 31 on the opposing side of the mitten body 14. For example, as depicted in FIGS. 5 and 6, if the pocket 30 is configured on the first side 13 of the mitten body 14, as shown in FIG. 5, the pocket lip 32 may be pulled up over the closed end 16 causing the pocket 30 to be turned inside out and causing the pocket 30 to be repositioned against the second side 15 of the mitten body 14 as an inside-out pocket 30*a*, as shown in FIG. 6.

Under the condition that the pacifier 40 is coupled to the exterior of the pocket 30 and the pocket lip 32 is thereafter pulled up over the closed end 16 of the mitten body 14, the configuration of the pacifier 40 on the exterior surface 31 of the pocket 30 may cause the pacifier 40 to be repositioned on the opposing side of the mitten body 14 within the pocket space 34 defined by the now inside-out pocket 30*a*. Embodiments of the infant mitten 10 may comprise the inside-out pocket 30*a* being deep enough and long enough that the pacifier 40 is completely concealed within the pocket space 34 under the condition the pocket 30 has been turned inside-out as an inside-out pocket 30*a*, as described herein.

Embodiments of the infant mitten 10 may comprise the pocket lip 32 being angled or slanted on the mitten 10 such that the opening of the pocket 30 is offset from side to side, or, in other words, so that the pocket 30 is longer on one side thereof. In this way, when the pocket lip 32 is pulled over the top of the mitten so that the pocket 30 is turned inside-out as an inside-out pocket 30*a*, the pacifier 40 may be partially concealed within the pocket space 34 of the inside-out pocket 30*a*, as described herein and as depicted in FIG. 6.

Embodiments of the mitten 10 may further comprise the coupling means 38 being coupled to the pocket 30, such that under the condition the pocket 30 is flipped inside-out, the coupling means 38, including the coupling straps 39, may be completely concealed within the newly formed interior pocket space 34 of the inside-out pocket 30. Embodiments of the mitten 10 may further comprise the coupling means 38 being a pair of corresponding coupling straps 39, the first coupling strap 39*a* of the coupling straps 39 being coupled to one edge of the exterior surface 31 of the pocket 30 and the second coupling strap 39*b* of the coupling straps 39 being coupled to the other opposing edge of the exterior surface 31 of the pocket 30. The first coupling strap 39*a* may be configured to fold over the exterior surface 31 to functionally engage the exterior surface 31 at the attachment portion 28. The second coupling strap 39*b* may be configured to fold over the first coupling strap 39*a* to functionally engage the first coupling strap 39*a*. Further, the first coupling strap 39*a* may be configured to also functionally engage a first side of the pacifier 40 (either at the handle 46, as shown in FIGS. 3-5, or at the base plate 42, as shown in FIG. 7) between the exterior surface 31 and the first coupling strap 39*a*. The second coupling strap 39*b* may be configured to also functionally engage a second side of the pacifier 40 (either at the handle 46, as shown in FIGS. 3-5, or at the base plate 42, as shown in FIG. 7) between the first coupling strap 39*a* and the second coupling strap 39*b*. In this way, the coupling straps 39*a* and 39*b* may functionally engage the pacifier 40 to releasably couple the pacifier to the pocket 30.

Embodiments of the mitten 10 may further comprise the mitten 10 being folded completely inside-out. Embodiments of the mitten 10 may comprise the mitten body 14 and pocket 30 being comprised of stretchy fabric, such as jersey cotton blend, or bamboo stretch fabric, so that the pocket 30 can be folded over the entire pacifier 40 and entire mitten 10 to keep any germs contained and away from the infant's mouths until the mitten 10 is washed and used again later. This helps keep the pacifier 40 and mitten 10 fully enclosed for washing later. The fabric used for the mitten body 14 may be the same fabric used for the pocket 30. Alternatively, the fabric used for the mitten body 14 may be different than the fabric used for the pocket 30.

Embodiments of the mitten 10 may further comprise the mitten 10 being configured to be placed on either the right or left hand of the infant and with the pacifier 40 being positioned relative to the infant's hand, and in particular relative to the infant's palm or relative to the infant's back of the hand, as desired by the parent or caregiver when placing the mitten 10 on the infant's hand. The mitten 10 may provide increased coordination when the mitten 10 is alternated from the left or right hand of the infant, thus developing the infant's use of both left and right hemispheres of the brain. This helps build coordination of the infant as it develops the ability to continually grab and insert the mitten 10 with attached pacifier 40 into its own mouth without parental guidance or assistance.

Embodiments of the mitten 10 may further comprise a pair 11 of mittens 10. Embodiments of the pair 11 of mittens 10 may comprise one mitten 10 having coupled thereto a 100% BFA free silicone pacifier 40, and a second mitten 10 having coupling means 38 for attaching a pacifier 40 to the pocket 30, means 38 such as smooth, flat, low-profile Velcro extensions to fit 80% of pacifiers 40 currently sold on the market. Embodiments of the pair 11 of mittens 10 may comprise one mitten 10 having coupling means 38 on the pocket 30 for attaching a pacifier 40 to the pocket 30, means 38 such as smooth, flat, low-profile Velcro extensions to fit 80% of pacifiers 40 currently sold on the market, and the second mitten 10 having a pocket 30 without any coupling means 38 for coupling a pacifier 40 thereto, as depicted in FIG. 8. Placing the mittens 10 in a pair 11 may be useful to wear as a pair to cover each of the infant's hands, while permitting one of the mittens 10 in the pair 11 to have coupled thereto, as desired, the pacifier 40 by the coupling means 38, including, for example, the coupling straps 39*a* and 39*b*.

Embodiments of the mitten 10 may provide several advantages including:

Embodiments of the mitten 10 provide easy facilitation/access of the pacifier 40 to the infant day or night.

Embodiments of the mitten 10 prevent the infant from scratching its face because the infant's hands are concealed within the mitten 10.

Embodiments of the mitten 10 provide the infant with a mitten 10 that can be used as a warming device for the infant's hands.

Embodiments of the mitten 10 provide a pocket 30 for the pacifier 40 to reside within during storage of the mitten 10. Additionally, if the pacifier 40 becomes dirty, the pocket 30 may be turned inside-out as described herein to conceal the pacifier 40 and make it inaccessible to the infant despite the mitten 10 remaining on the infant's hand. Additionally, the entire mitten 10 may be turned inside out to create a larger pocket for the pacifier 40, to thus conceal the pacifier 40, whether in or out of the pocket 30, within the inside-out mitten 10.

Embodiments of the mitten 10 provide visual and mental stimulation to the infant as it increases coordination if the mitten 10 is alternated between the infant's left and right hands. The mitten 10 can be placed on either hand, thus developing the infant's use of (left and right) both hemispheres of the brain. Helps build coordination of the infant as it develops the ability to continually grab and reach for the mitten 10.

Embodiments of the mitten 10 provide immediate accessibility for the infant to self-soothe using the mitten 10 having the pacifier 40 thereon and to fall back asleep day or night. Some parents are woken up 2-5 times per night because the infant wants the pacifier 40. Without the mitten 10, the parent must wake up, find the pacifier 40 and replace it in the infant's mouth. However, the infant can utilize the mitten 10 to find the pacifier 40 on its own and naturally fall back asleep without the intervention of the parent.

Embodiments of the mitten 10 help infants facilitate their own need for a pacifier 40 and sleep longer, as they are able to place their own hands to their mouth at 3-4 months old. It will help them and parents have more sleep at night due to the avoidance of having the parent replace the pacifier 40 in the infant's mouth.

Embodiments of the mitten 10 help infants facilitate their own need for a pacifier day or night. It simply provides longer, uninterrupted sleep, as infants can bat and grab things with their hands at about 3-4 months old and are able to place their own hands in and up to their mouth easily at stage 3-4 months old. Science indicates that a normal developing infant is able to place items into their mouths successfully at this stage of development. All infants are born knowing how to instinctively "root" for their mom's nipple in search of food. At about 3-4 months of age, an infant is able to bat around hands and actively place their fingers in their mouth.

Embodiments of the mitten 10 help infants and parents have more sleep at night due to the avoidance of having to replace the pacifier in the infant's mouth when the pacifier 40 falls out—night or day. The mitten 10 may be intended for babies 4-15 months old or older.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. An infant glove comprising:

a body having a first side and a second side and an open end, the first and second sides of the body defining an opening therebetween, the opening being accessible via the open end, the opening being configured to receive an infant's hand;

a pocket configured on the first side of the body, the pocket being configured to be turned inside-out; and a pacifier coupled to the infant glove, wherein the pocket being turned inside-out repositions the pocket on the second side of the body with the pacifier retained within the inside-out pocket;

wherein the pacifier is releasably coupled to the pocket and turning the pocket inside-out results in an inside-out pocket on the second side of the body with the pacifier retained between the inside-out pocket and the body.

2. The infant glove of claim 1, wherein the body is a mitten.

3. The infant glove of claim 1, wherein the pacifier is fixedly coupled to the pocket and turning the pocket inside-out results in an inside-out pocket on the second side of the body with the pacifier retained between the inside-out pocket and the body.

4. The infant glove of claim 1, further comprising first and second coupling straps, the first coupling strap being configured on an edge of the pocket and the second coupling strap being configured on an opposing edge of the pocket, the first and second coupling straps being configured to communicate with one another to releasably secure the pacifier to the pocket.

5. The infant glove of claim 4, wherein the first coupling strap is configured to secure a portion of the pacifier between the pocket and the first coupling strap, and wherein the second coupling strap is configured to secure another portion of the pacifier between the first coupling strap and the second coupling strap.

6. The infant glove of claim 5, wherein the inside-out pocket conceals the first and second coupling straps therein.

7. The infant glove of claim 1, further comprising an elastic member configured on the first side of the body and proximate the open end.

8. The infant glove of claim 1, further comprising a strap member configured on the second side of the body and proximate the open end.

9. The infant glove of claim 1, wherein the pocket further comprises a slanted opening that partially conceals the pacifier within the inside-out pocket.

10. A pacifier holder comprising:

a mitten body having a first side and a second side and an open end, the first and second sides of the mitten body defining an opening therebetween, the opening being accessible via the open end;

a pocket configured on the first side of the mitten body, the pocket being configured to be turned inside-out; and coupling means for coupling a pacifier to the pocket, wherein the pocket being turned inside-out repositions the pocket on the second side of the mitten with the pacifier and the coupling means within the inside-out pocket;

wherein the coupling means releasably couples the pacifier to the pocket and turning the pocket inside-out results in an inside-out pocket on the second side of the body with the pacifier retained between the inside-out pocket and the body.

11. The pacifier holder of claim 10, wherein the coupling means fixedly couples the pacifier to the pocket and turning the pocket inside-out results in an inside out pocket on the second side of the body with the pacifier retained between the inside-out pocket and the body.

12. The pacifier holder of claim 10, wherein the coupling means comprises first and second coupling straps, the first coupling strap being configured on an edge of the pocket and the second coupling strap being configured on an opposing edge of the pocket, the first and second coupling straps being configured to communicate with one another to releasably secure the pacifier to the pocket.

13. The pacifier holder of claim 12, wherein the first coupling strap is configured to secure a portion of the pacifier between the pocket and the first coupling strap, and wherein the second coupling strap is configured to secure another portion of the pacifier between the first coupling strap and the second coupling strap.

14. The pacifier holder of claim 10, further comprising an elastic member configured on the first side of the body and proximate the open end.

15. The pacifier holder of claim 10, further comprising a strap member configured on the second side of the body and proximate the open end.

16. The infant glove of claim 10, wherein the pocket further comprises a slanted opening that partially conceals the pacifier within the inside-out pocket.

17. A method of using a pacifier, the method comprising:

providing an infant glove having first and second sides and a pocket on the first side;

securing a pacifier to the pocket; and turning the pocket inside-out to reposition the pocket as an inside-out pocket on the second side of the infant glove with the pacifier within the inside-out pocket;

wherein securing the pacifier to the pocket further comprises securing a portion of the pacifier between the pocket and a first coupling strap, and securing another portion of the pacifier between the first coupling strap and a second coupling strap.

* * * * *